United States Patent [19]

Calvin

[11] 3,936,987

[45] Feb. 10, 1976

[54] INTERLOCKING BRICK OR BUILDING BLOCK AND WALLS CONSTRUCTED THEREFROM

[76] Inventor: Edward L Calvin, 181 Country Club Drive, Rock Hill, S.C. 29730

[22] Filed: Jan. 13, 1975

[21] Appl. No.: 540,339

[52] U.S. Cl. ..... 52/309; 52/585; 52/586

[51] Int. Cl.[2] ..... E04C 1/10

[58] Field of Search ..... 52/585, 586, 405, 309

[56] References Cited

UNITED STATES PATENTS

| | | | |
|---|---|---|---|
| 2,134,637 | 10/1938 | Loucks | 52/585 |
| 3,166,873 | 1/1965 | Rosenfeld | 52/585 |
| 3,204,376 | 9/1965 | Elgenstierna | 52/612 |
| 3,292,331 | 12/1966 | Sams | 52/405 |
| 3,430,403 | 3/1969 | Muse | 52/585 |
| 3,512,327 | 5/1970 | La Padura | 52/309 |
| 3,546,833 | 12/1970 | Perreton | 52/405 |
| 3,783,566 | 1/1974 | Nielson | 52/585 |
| 3,864,885 | 2/1975 | Muse | 52/585 |

FOREIGN PATENTS OR APPLICATIONS

| | | | |
|---|---|---|---|
| 461,529 | 12/1913 | France | 52/585 |
| 12,920 | 6/1902 | United Kingdom | 52/405 |
| 812,205 | 8/1951 | Germany | 52/586 |

*Primary Examiner*—Frank L. Abbott
*Assistant Examiner*—Henry Raduazo
*Attorney, Agent, or Firm*—B. P. Fishburne, Jr.

[57] ABSTRACT

A concrete block simulating a Norman brick is formed with two large cores separated by a central web. The cores are adapted to receive insulating foam during manufacturing of the block. Each block is grooved in its opposite ends and recessed in its central web for the reception of wedge elements or keys formed of plastic or the like. Adjacent blocks in each course are interlocked and the courses of walls constructed from the blocks in either a stacked bond or running bond are mechanically interlocked and properly aligned. Epoxy cement is utilized for bonding of courses in a customized wall or in prefabricated panel sections utilizing the interlocking block.

3 Claims, 10 Drawing Figures

FIG. 1
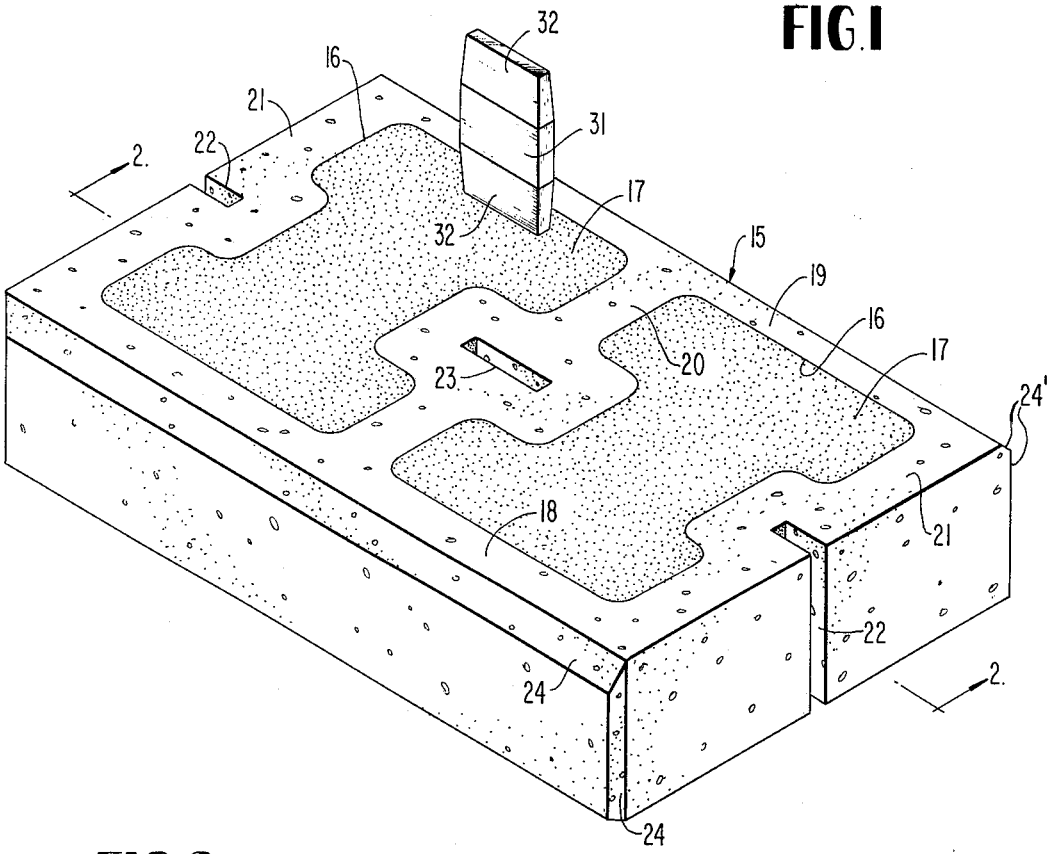
FIG. 2
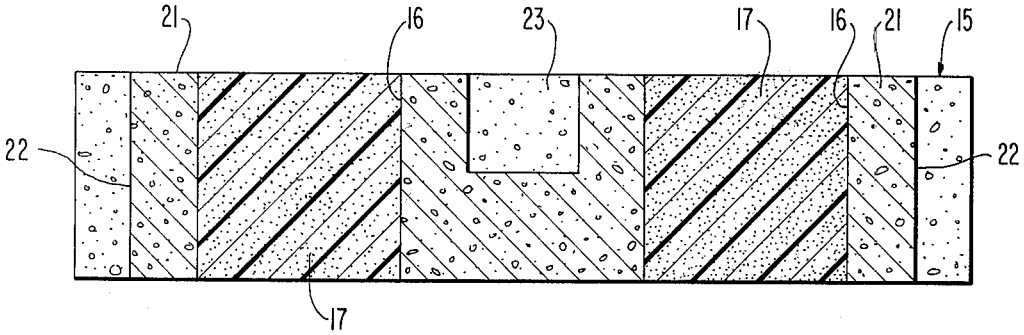
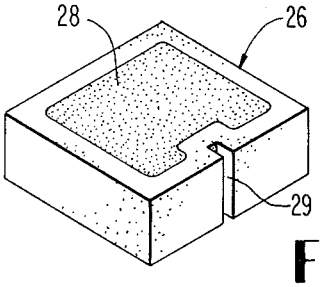
FIG. 3
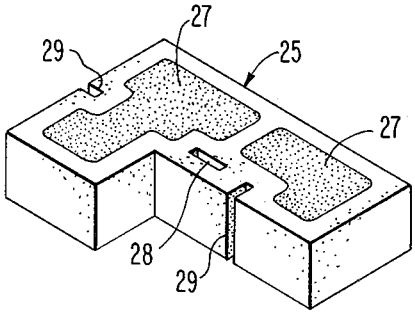
FIG. 4

INTERLOCKING BRICK OR BUILDING BLOCK AND WALLS CONSTRUCTED THEREFROM

BACKGROUND OF THE INVENTION

The invention has arisen as a result of a long-standing need in the art for a practical masonry module which may be used in the construction of buildings and walls by relatively unskilled labor, without the necessity for constantly checking on alignment by the use of a level and string.

More particularly, the invention saves time and labor in the construction of walls with either a stacked or running bond configuration. In its preferred form, the module formed of concrete in a conventional block machine is made to resemble a Norman brick in shape, size and color. In the formation of walls, epoxy cement is utilized as the bonding agent without the use of conventional mortar. However, the traditional mortar joints may be simulated by chamfering the end and top corners of both faces of each module.

The interlocking feature of the invention provides precise alignment of each module with others in the wall without the use of external geometric alignment means. The alignment feature consists of providing a first recess in the center top of each module and a pair of end vertical grooves in the module, the grooves and recess lying in a common vertical plane through the center of the module. Interlocking wedges or keys preferably formed of relatively soft plastic or other suitable material are introduced into the center top recess of each module with one-half of the wedge or key projecting above the top face of the module. In the usual running bond wall structure, each new brick or module in the wall will be fitted between a pair of upstanding wedges projecting from the centers of adjacent modules in the course immediately therebelow. In this manner, each module becomes mechanically interlocked with two modules of the preceding course and with both immediately adjacent modules in the same course, thus causing the entire wall structure to be properly aligned and interlocked until the epoxy bond becomes set or hardened to provide the ultimate high strength joints between all modules of the wall or structure.

The modules can be laid in a stacked bond by simply inserting the wedges in the end grooves of adjacent modules rather than in the center recesses thereof, as will be fully described.

Another important feature of the invention resides in the filling of the module cores with foam insulation during the manufacturing of the modules and while they are still on the pallets after forming in the block machine. The pre-insulated modules or bricks, after being laid up in either running or stacked bond, have their foam filled cores in vertical alignment in the wall, thereby providing essentially continuous insulation in a hollow masonry wall. The foam insulation will not settle in the hollow wall like loose insulation material and will resist water saturation. No additional labor whatsoever is required for building an insulated wall with the modules of the invention. In some instances, if desired, the modules can be manufactured without cores and without the insulation feature.

The invention lends itself well to the formation of prefabricated panels utilizing the interlocking arrangement and epoxy cement bonding in either running or stacked bond. These panels would be pre-assembled at a factory prior to transporting to a job site for erection with other panels. Adjacent panels may be joined along straight vertical edges by placing them on preleveled bases. In the joining of adjacent panels, temporary alignment at the meeting vertical straight edges is obtained by inserting continuous alignment or locking bars into the end vertical grooves of the panels. If an expansion joint is required, the rigid steel bar can be used to align and lock the adjacent panels, and a rubber expansion element can be inserted to seal the joint. Normally, the abutting vertical edges of panels are bonded by epoxy mortar.

The prior patented art, while containing a relatively large number of proposals relating to interlocking building elements, has failed to provide an arrangement which has met with any widespread acceptance in the industry. This lack of acceptance has been due to excessive cost of manufacturing the interlocking modules and, in some instances, the requirement for as much or even more labor in the construction of a wall or building as in the case of non-interlocking types. In short, the prior art proposals have not proven to be fully practical and efficient in terms of the desired requirements of reduced manufacturing and labor costs and the appearance of the structures produced with the modules. The present invention is believed to satisfy all of these requirements and therefore constitutes a significant improvement on the known prior art and a practical answer to the long-standing need for a construction element of this type.

Other features and advantages of the invention will become apparent during the course of the following detailed description taken in connection with the accompanying drawings.

BRIEF DESCRIPTION OF DRAWING FIGURES

FIG. 1 is an exploded perspective view of a building module or brick embodying the invention and a coacting wedge or key employed therewith for interlocking with adjacent modules in a wall.

FIG. 2 is a central vertical section through the module taken on line 2—2 of FIG. 1.

FIG. 3 is a perspective view, on a reduced scale, showing a half brick employed in the invention.

FIG. 4 is a similar view showing a corner brick.

DETAILED DESCRIPTION

Figure 5:
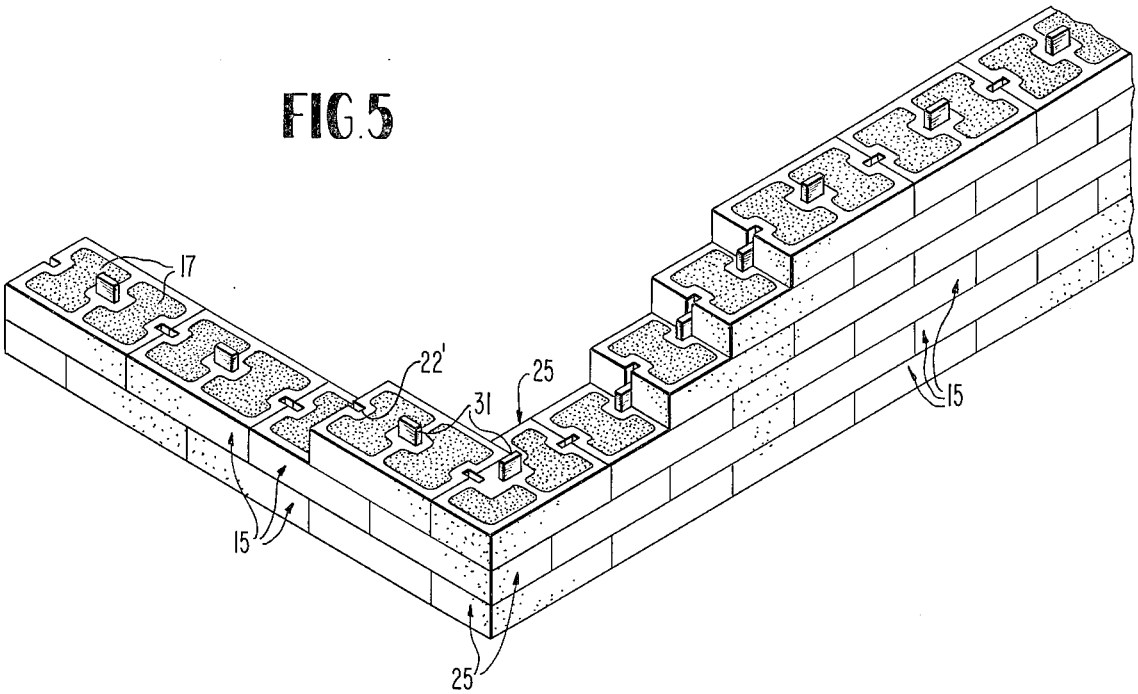
FIG. 5 is a perspective view of a wall structure produced by the interlocking bricks or modules laid in a running bond.

Referring to the drawings in detail wherein like numerals designate like parts, attention is directed initially to FIGS. 1 and 2 showing a basic building module embodying the invention and designated by the reference numeral 15. This module 15 may be formed in a standard concrete block machine using a mixture of Portland cement, sand, gravel and mineral pigment to impart a desirable brick-like color. Internal waterproofing may be employed to control moisture absorption. Preferably, the module 15 is shaped to provide the appearance of a standard Norman brick when included in a wall structure.

The module or brick 15 has two large core openings 16 formed therethrough to qualify it for hollow masonry construction, and preferably the core openings are filled with porous insulation 17 during the manufacturing process. More particularly, plastic foam such as polyurethane self-foaming compound is injected in the proper amount into each core opening while the bricks are still on the pallets in the forming machine. The amount of injected polyurethane will be controlled to completely fill the core opening upon completion of the curing process. The foam can be placed in the green block directly from the block machine, if the block is air-cured, or can be injected after removal of the block from the curing oven. As will be further discussed, when the insulation-filled bricks or blocks are laid up in either a running bond or a stacked bond, the aligned cores in the wall will provide an essentially continuous insulation in the wall cavity. The cured foam insulation 17 cannot settle in the wall like loose insulation material and will not soak up water to cause loss of insulation value. No increased labor is required to completely insulate a wall during its construction with the brick embodying the invention.

The brick 15 further comprises front and rear walls 18 and 19, or webs, a center front-to-back web 20 separating the core openings 16, and end webs 21, all integrally joined as shown. At the midpoint of the brick between its forward and rear sides, the end webs 21 are provided with grooves 22 extending through the top and bottom faces of the brick and also opening through its end faces. The center web 20 is similarly provided with a recess or slot 23 whose bottom terminates near the center of thickness of the brick while opening through the top face thereof and in lateral alignment with the two grooves 22.

Figure 10:
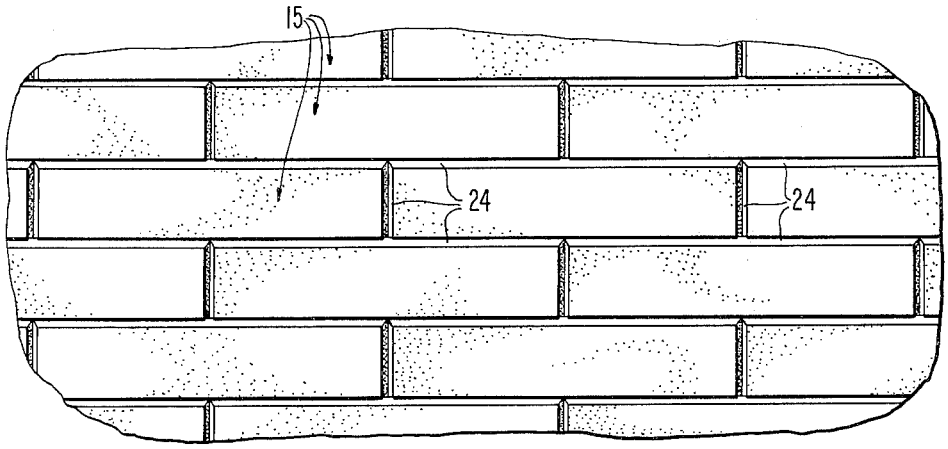
FIG. 10 is a fragmentary side elevation of a wall section constructed in running bond according to the invention and particularly illustrating simulated mortar joints.

In order to simulate the appearance of conventional mortar joints in a wall, FIG. 10, each brick or module is chamfered on the end and top corners at its forward and reverse sides as indicated at 24 and 24' in the drawings. Preferably, a relatively larger chamfer is provided along the front and back top face edge of each brick as is apparent in FIG. 1.

The brick or module 15 thus far described is the standard stretcher brick utilized in wall construction. To satisfy requirements at the corners of structures and in the formation of certain prefabricated panels, yet to be described, corner modules 25, right and left hand, and half-bricks or modules 26, as depicted in FIGS. 4 and 3, are provided, as a part of the invention. These modules also preferably contain foamed insulation filled cores 27 and 28, vertical grooves 29, and a top recess 30 whose functions will be more apparent during the description of walls in accordance with the invention.

Figure 6:
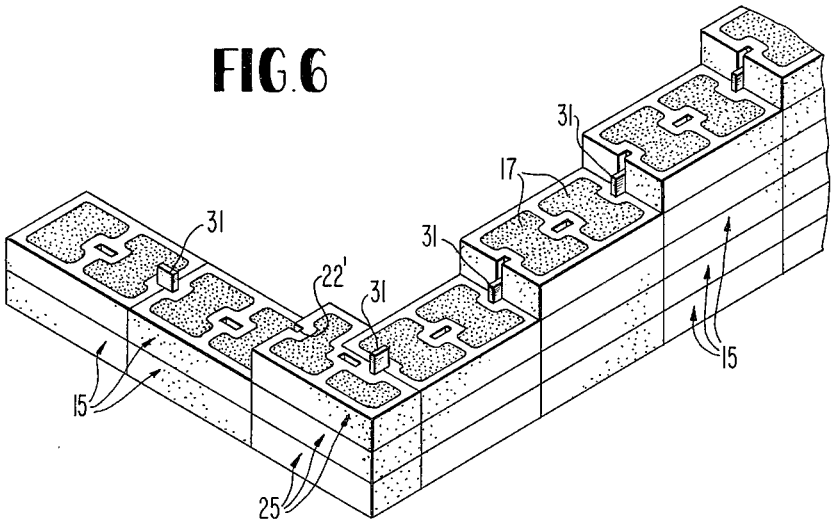
FIG. 6 is a similar view of a wall structure where the interlocking modules are in stacked bond.

A uniform size wedge or key element 31, preferably formed of plastic or another similar material, is provided for entry in a snug manner into the various grooves 22, etc. and into the slots 23 during the formation of walls having either a running or stacked bond, FIGS. 5 and 6, respectively. Each wedge 31 preferably has its opposite end portions 32 somewhat tapered on all four sides and includes a non-tapered rectangular cross section center portion with full dimension straight sides.

Figure 7:
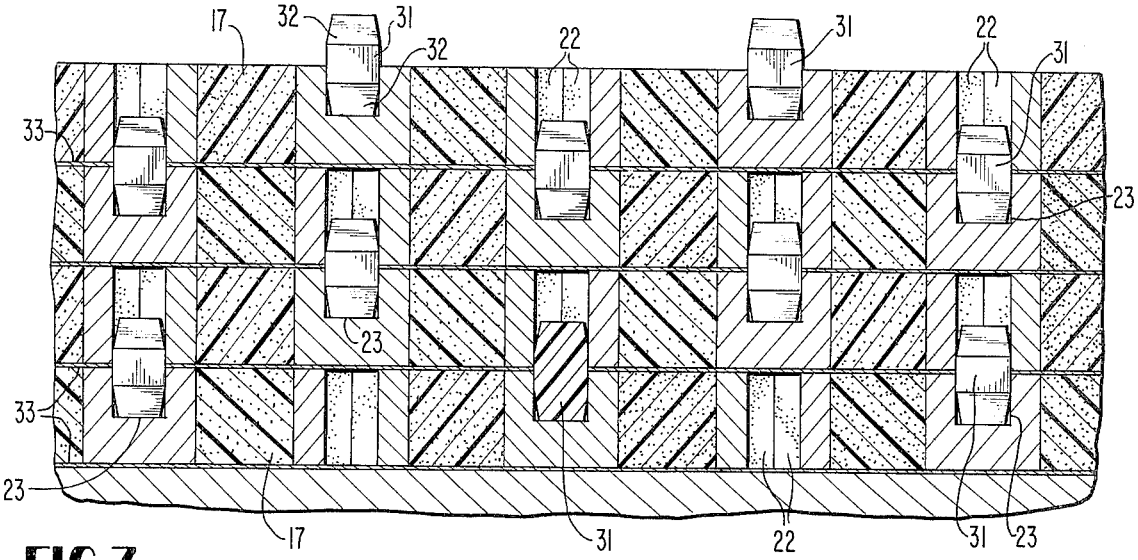
FIG. 7 is an enlarged fragmentary vertical section through a wall composed of interlocked modules according to the invention in running bond.

In the construction of a custom wall with the usual running bond, FIGS. 5, 7 and 10, after applying epoxy mortar 33 in a bead along the inside and outside edges of a brick and to the end of the adjoining brick, a new brick 15 is fitted between two wedges 31 protruding from the centers of adjacent bricks, it being understood that, when a wedge 31 is placed in a top slot 23 of a brick, one-half of the wedge or key will project above the upper face of the brick. Therefore, when the new brick is laid down between two projecting wedges, such wedges will enter the end grooves 22 of the newly-laid brick and key and align it in the wall structure until the epoxy cement sets. This arrangement is clearly visible in FIGS. 5 and 7 and the simulated mortar joints produced by the chamfering 24 is clearly evident in FIG. 10. When each brick is pressed down to compress and spread the epoxy mortar 33 to a thickness of about one-sixteenth inch, the wedges 31 cause the brick to be aligned in both horizontal directions with the bricks in the immediately underlying course. Proceeding in this manner, each brick is interlocked with a pair of bricks in the preceding course and with the two adjacent bricks in the same course, causing the entire wall to be locked in proper alignment until the cement 33 sets to provide the ultimate bond strength in the wall.

Proceeding to FIG. 6 of the drawings, a custom wall utilizing the identical bricks 15 can be laid in stacked bond by a very similar procedure, by simply inserting the wedges 31 in the recesses formed by the mating end grooves 22 of the courses rather than in the top center recesses 23, as previously described. This adaptability of the brick and wedges to either running or stacked bond walls is a prime feature of the invention.

Another useful function of the end groove 22 is that it may also serve as a recess at window openings in a wall for installing a window sash, for example, in the location of the end groove 22' in both FIGS. 5 and 6.

As depicted in both of these figures, a wall corner is formed by the utilization of the described corner bricks 25 which are made available for either right or left hand corners. As shown in these figures, the wedges 31 may be received by the slot 28 or the grooves 29, as required to join corner bricks with adjacent stretcher bricks 15 in either a running bond or a stacked bond arrangement. Here again, the invention is most versatile and adaptable to different requirements found in construction.

It may be observed in FIG. 7 showing the running bond arrangement that the aligned pre-insulated bricks have their insulation components 17 in registration to form continuous insulation in the wall cavity. The same continuity of insulation will be present in the stacked bond arrangement.

Figure 8:
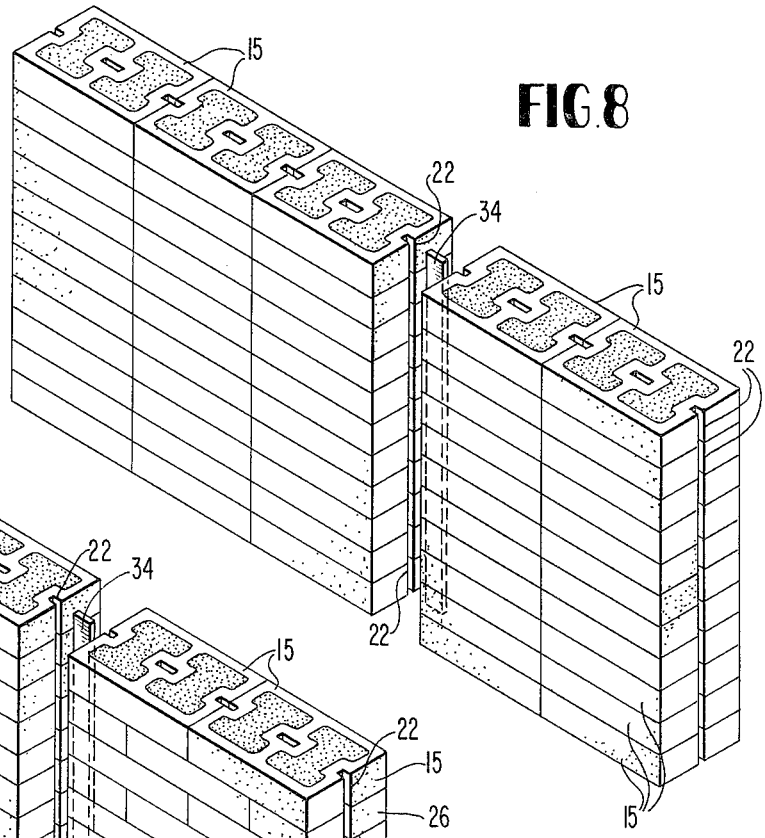
FIG. 8 is an exploded perspective view of prefabricated panels made from modules in stacked bond.
Figure 9:
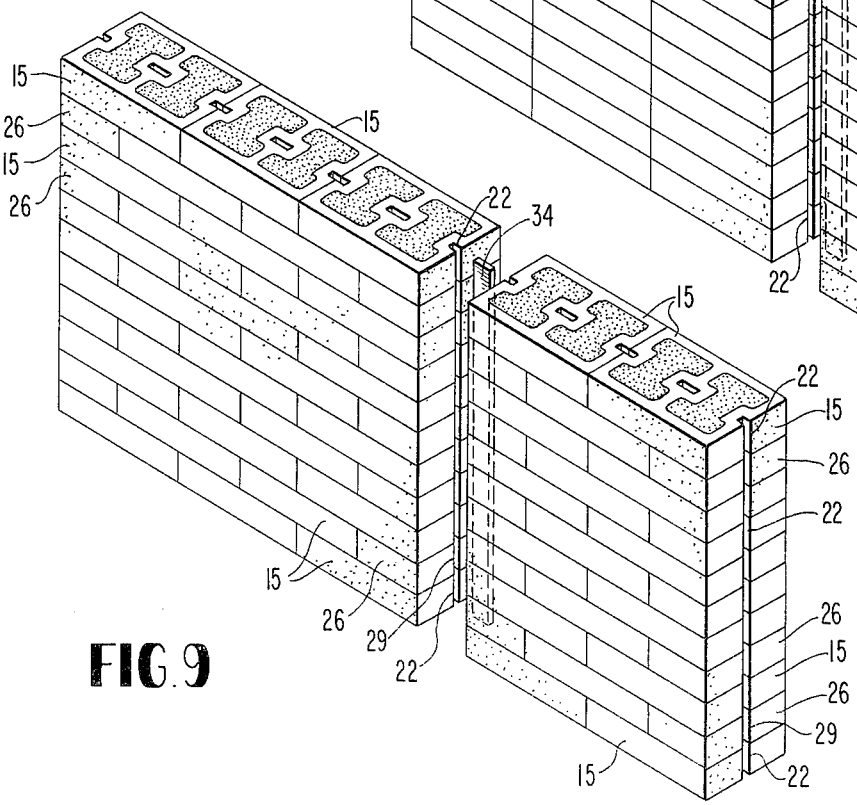
FIG. 9 is a similar view of prefabricated panels made from modules in running bond.

FIGS. 8 and 9 show the adaptability of the invention to prefabricated panels constructed in the factory for transport to a job site and erection on the site. The use of epoxy cement produces a panel of sufficient strength to permit handling in shipment without special reinforcement or supports. The prefabricated panels in stacked bond, FIG. 8, or running bond, FIG. 9, are designed to complete one modular section of wall adapted to be joined to another prefabricated panel along a straight vertical joint. If a running bond is employed, FIG. 9, the panel edge will be completed with stretcher and half-bricks 15 and 26 in alternating relation. In the case of stacked bond, FIG. 8, the vertical straight edge will result naturally from the stacking of full or stretcher bricks 15 in the prefabricated panels.

In either case, when the prefabricated panels are set up on the job site on a suitable preleveled base, using epoxy mortar, their opposing straight vertical edges are ready for joining in the wall. The edge of one panel is attached to an adjacent panel, again using epoxy mortar, with a temporary alignment and support means in the form of a steel bar 34 of the proper dimensions to enter the aligned grooves 22, FIG. 8, or 22 and 29, FIG. 9. If an expansion joint is required rather than a rigid joint between panel sections, the steel bar 34 can be used to align and lock the panels together, and a rubber expansion element can be inserted to seal the joint. The locking together and aligning of the prefabricated panels in the described manner on a job site represents still a further valuable use of the end grooves 22 and 29 of the stretcher and half-bricks.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a wall construction including a plurality of courses of blocks, and the blocks in each course being in end-to-end abutting relationship, the improvement which comprises each block in each course being rectangular and dimensioned to simulate a brick, each block having forward and rear webs and end webs joined in right angular relationship and a center front-to-back web parallel with the end webs and joined with said forward and rear webs, said center web having an enlargement substantially midway between the forward and rear webs, said end webs having interior side enlargements spaced from and opposing said enlargement of the center web, all of said webs and said enlargements being continuous in a vertical direction and extending from the top face to the bottom face of the block, the exterior faces of said end webs provided midway between the forward and rear webs with narrow constant width grooves which extend vertically and continuously between the top and bottom faces of said block and opening through said top and bottom faces, said center web enlargement having a centrally located rectangular cross section slot formed therein vertically and being aligned laterally with said grooves and being of substantially equal width with the grooves in the front-to-back direction, said slot having a bottom wall substantially at the center of vertical thickness of the block, said slot elongated in the direction between said end webs and grooves, said webs of the block forming a pair of equal size and substantially identically shaped large core openings extending entirely through the block from top-to-bottom thereof, foam insulation material substantially completely filling said core openings and being flush with the flat top and bottom faces of the block, and slender rectangular cross section key elements having symmetrically arranged tapering wedge-like end portions and full thickness intermediate portions engaging snugly in said slots and grooves of all of the blocks and all of the courses to thereby firmly mechanically interlock the courses in properly registering relationship while interlocking the blocks of the courses in properly aligned relationship, said key elements having a length in the vertical direction during use to bottom in said slots with substantially half of their lengths projecting above the tops of the slots for entry into opposing registering pairs of said end web grooves of adjacent blocks in the courses, thin layers of epoxy cement bonding together the courses of blocks in the wall construction, and each block being chamfered on its upper horizontal corners and both end vertical corners at its forward and rear sides, said chamfers simulating brick wall mortar joints in said wall construction and said chamfers rendering the blocks reversible in the front-to-back direction.

2. The construction defined in claim 1, wherein said blocks are molded from concrete and said key elements are formed of somewhat yielding material.

3. The construction defined in claim 2, and said key elements formed of plastic.

* * * * *